United States Patent [19]

Thomson

[11] 3,957,198

[45] May 18, 1976

[54] TOY CASH REGISTER

[75] Inventor: James E. Thomson, Pleasant Lake, Mich.

[73] Assignee: Western Stamping Corporation, Jackson, Mich.

[22] Filed: Aug. 28, 1974

[21] Appl. No.: 501,166

[52] U.S. Cl. ..... 235/1 E; 235/12
[51] Int. Cl.[2] ..... G06C 27/00
[58] Field of Search ..... 235/1 E, 12

[56] References Cited

UNITED STATES PATENTS 3,870,864 3/1975 Brandstatter ..... 235/1 E

FOREIGN PATENTS OR APPLICATIONS 143,163 5/1920 United Kingdom ..... 235/1 E
617,803 2/1949 United Kingdom ..... 235/1 E
991,998 5/1965 United Kingdom ..... 235/1 E

*Primary Examiner*—Stephen J. Tomsky
*Attorney, Agent, or Firm*—Harness, Dickey & Pierce

[57] ABSTRACT

A toy cash register having vertically slidable plastic indicator targets and plunger-type actuating keys which are integral with the targets and with interconnecting parts including hinging portions. When raised, the targets are held up by resilient fingers formed on and integral with a rockable plastic latch plate which is swingable to release the targets. The working and locating parts, formed primarily of plastic, interlock with each other and with supporting portions of a metal housing structure so that the need for separate fasteners is virtually eliminated.

32 Claims, 29 Drawing Figures

FIG. 19.
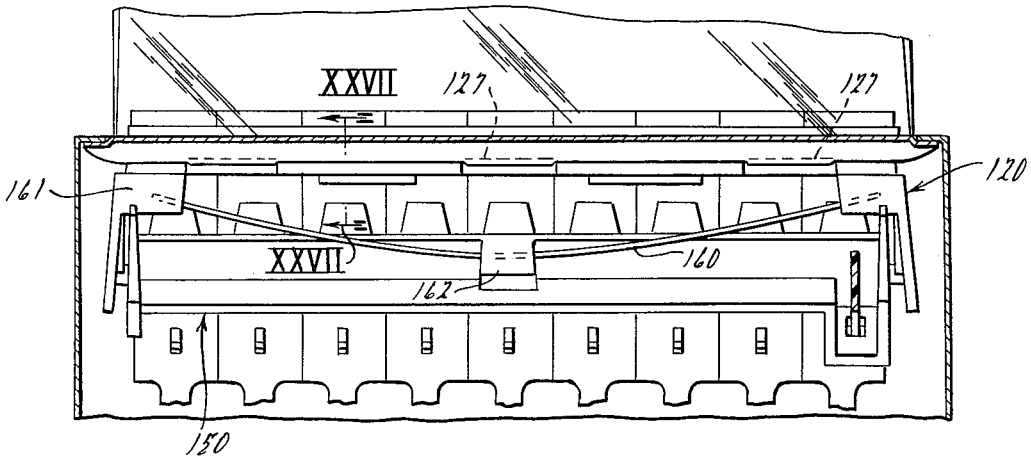
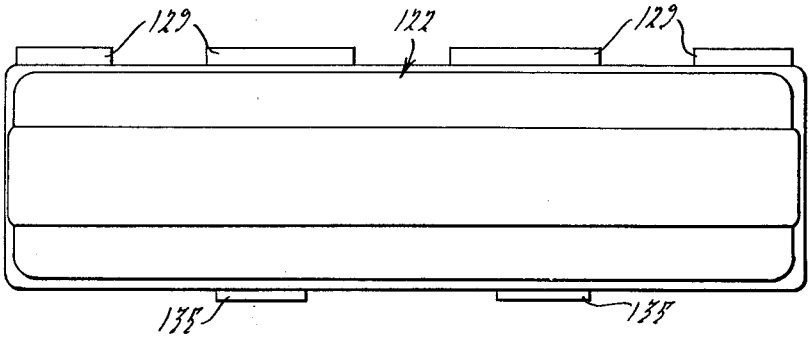
FIG. 29.
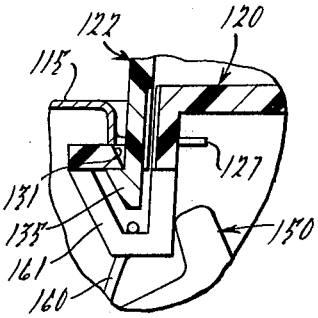
FIG. 27.
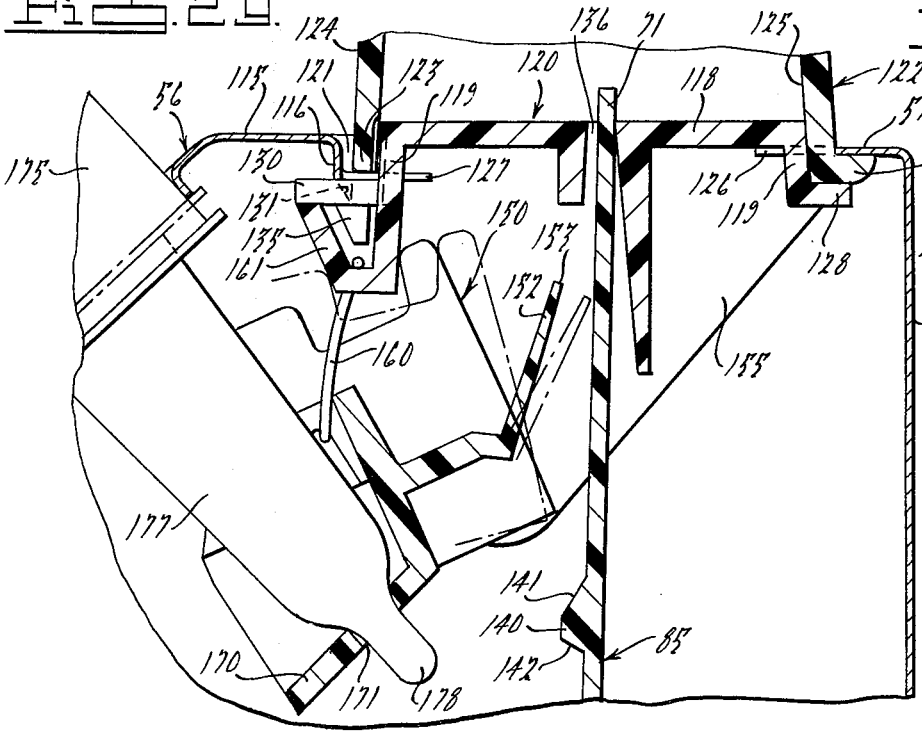
FIG. 28.

TOY CASH REGISTER

BACKGROUND OF THE INVENTION

The manufacture of toys and educational devices of the types which require manual assembly of large numbers of operative parts has become so costly due to rising labor rates that many persons desiring to purchase them have been prevented from doing so by the necessary high prices.

The overall objective of the present invention is to provide an improved toy cash register from which children can learn numbers and the mathematical operations of change making while at play, and which accurately simulates the action of actual cash registers used in trade, but which is manufacturable at substantially lower cost than known types that are capable of similar performance.

Other objects and advantages will become apparent upon further consideration of the present disclosure in its entirety.

BRIEF DESCRIPTION OF THE FIGURES OF DRAWING

FIG. 19 is a fragmentary sectional elevational view taken substantially on the line XIX—XIX of FIG. 3 and looking in the direction of the arrows;

FIG. 26 is an enlarged fragmentary sectional view of the portion within the circle designated XXVI in FIG. 6;

FIG. 27 is an enlarged fragmentary sectional view taken substantially on the line XXVII—XXVII of FIG. 19 and looking in the direction of the arrows;

FIG. 29 is a top plan view of the window member.

DETAILED DESCRIPTION OF PREFERRED FORM OF THE INVENTION

Figure 1:
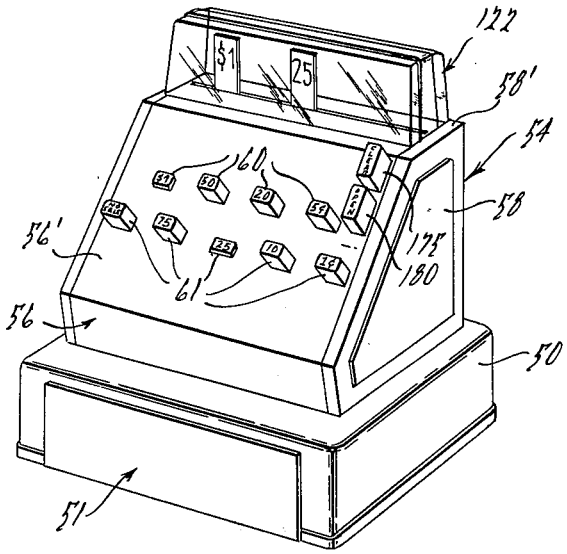
FIG. 1 is a perspective view of a toy cash register constructed in accordance with the present invention.
Figure 2:
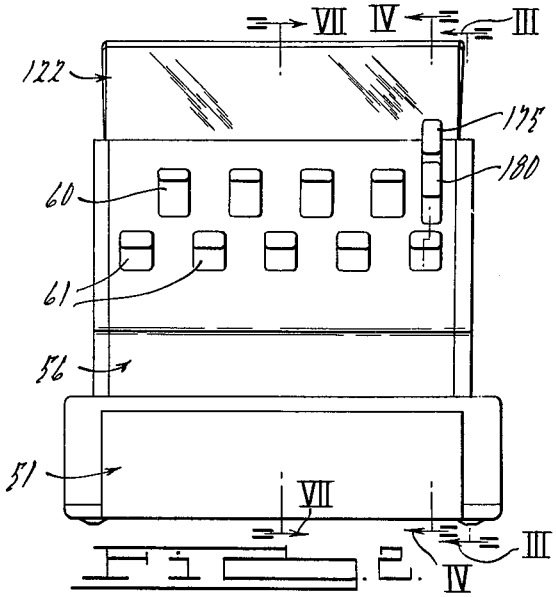
FIG. 2 is a front elevational view thereof.
Figure 3:
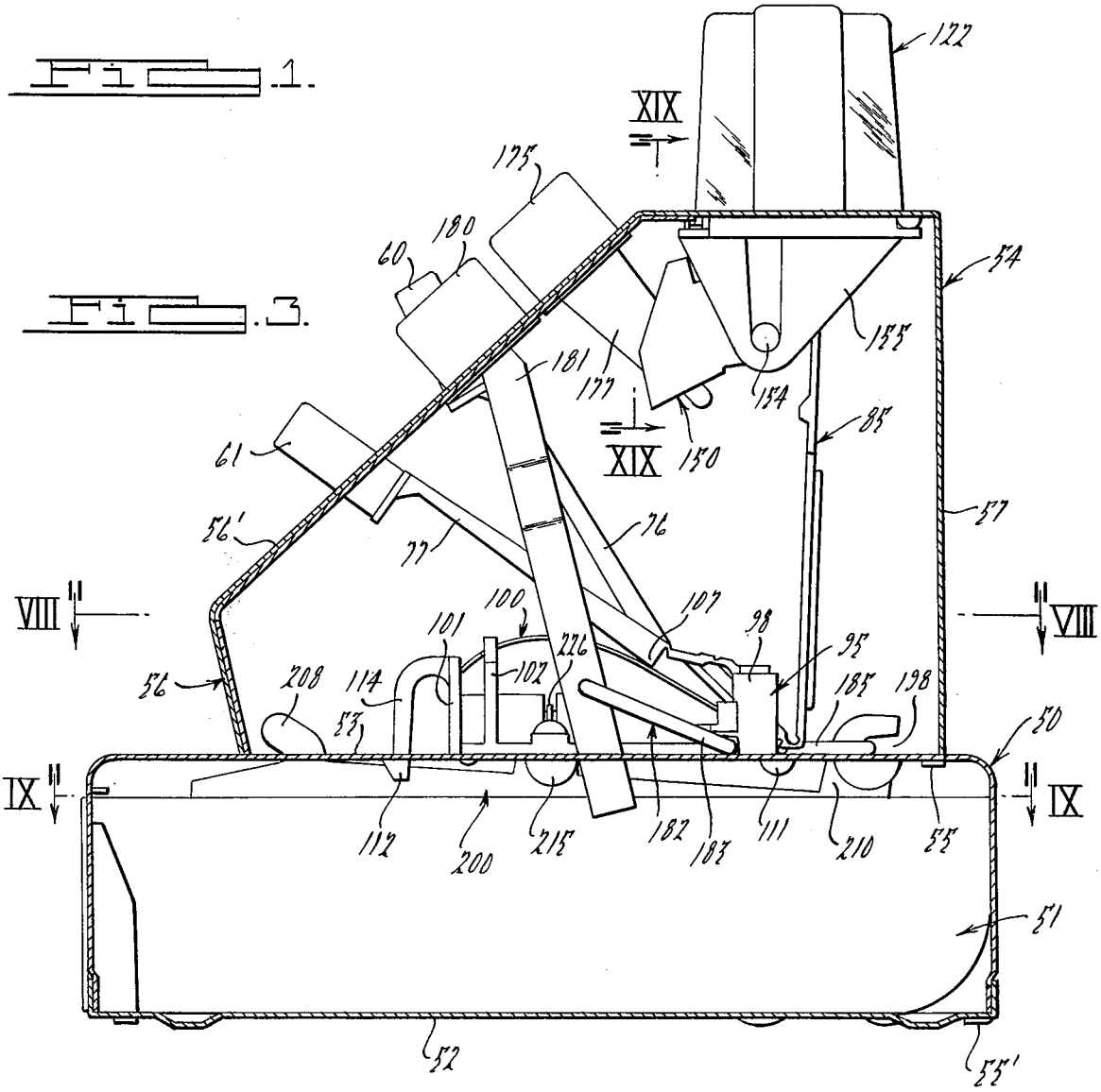
FIG. 3 is a vertical sectional view taken substantially on the line III—III of FIG. 2 and looking in the direction of the arrows.
Figure 7:
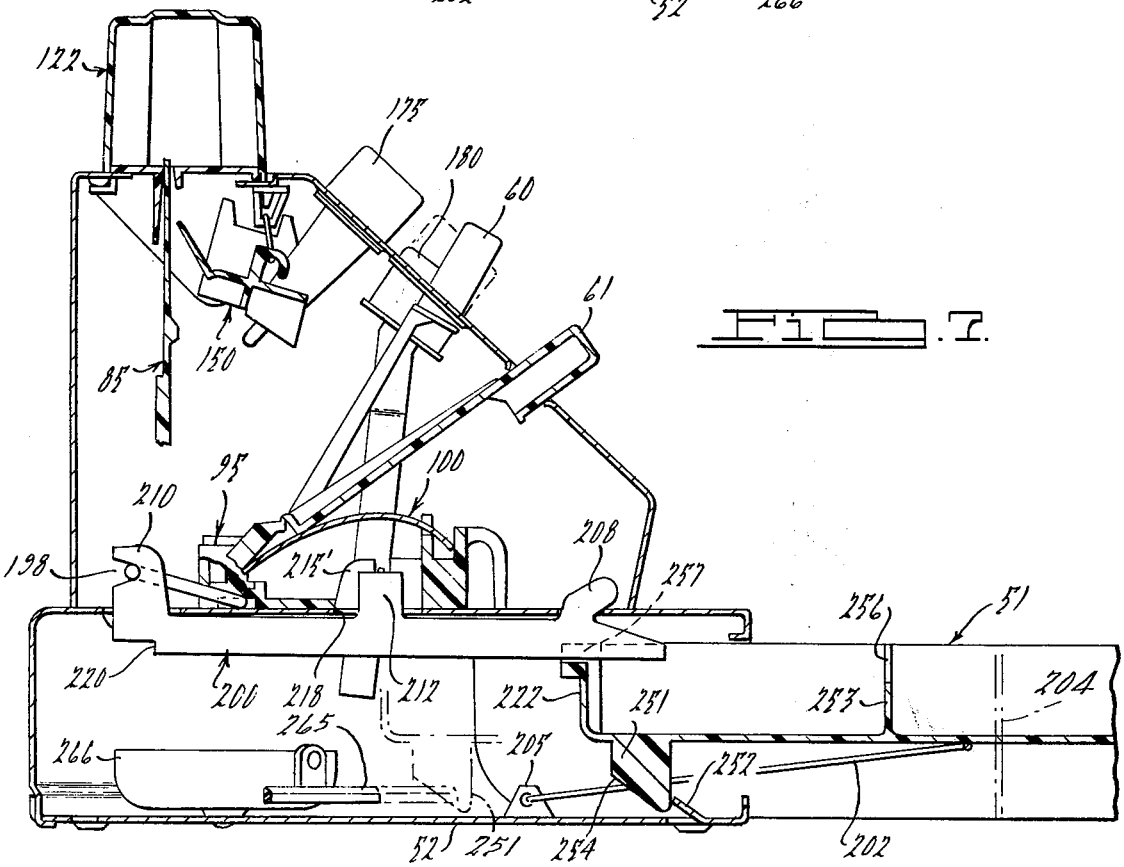
FIG. 7 is a similar vertical sectional view taken substantially on the line VII—VII of FIG. 2 and looking in the direction of the arrows, showing the drawer released and projected.
Figure 9:
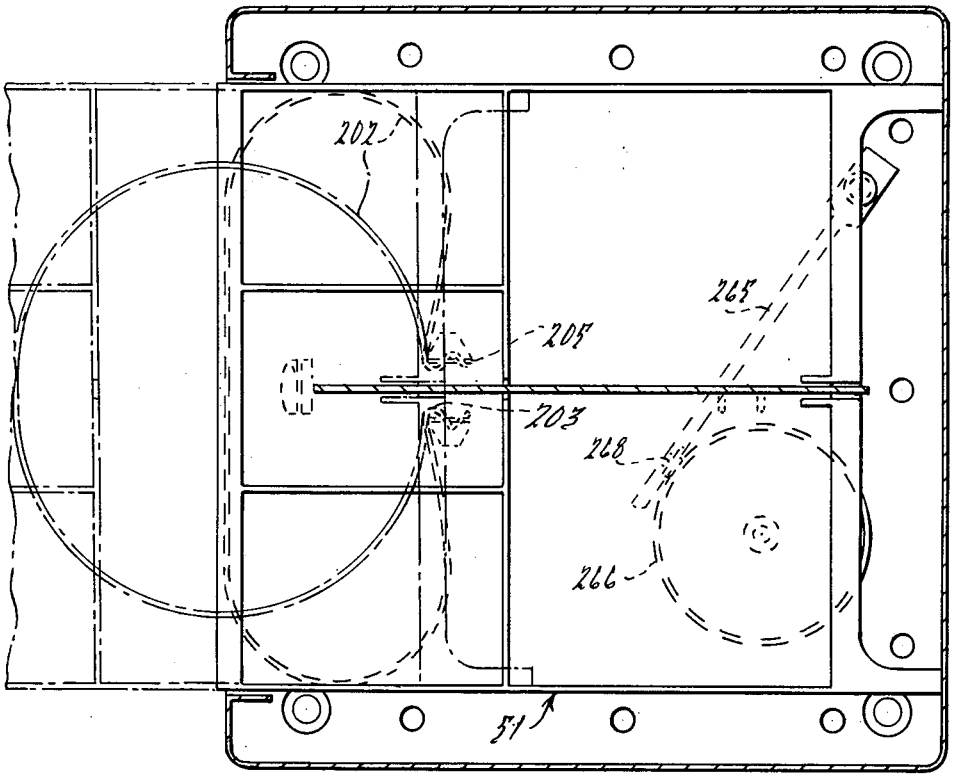
Figure 10:
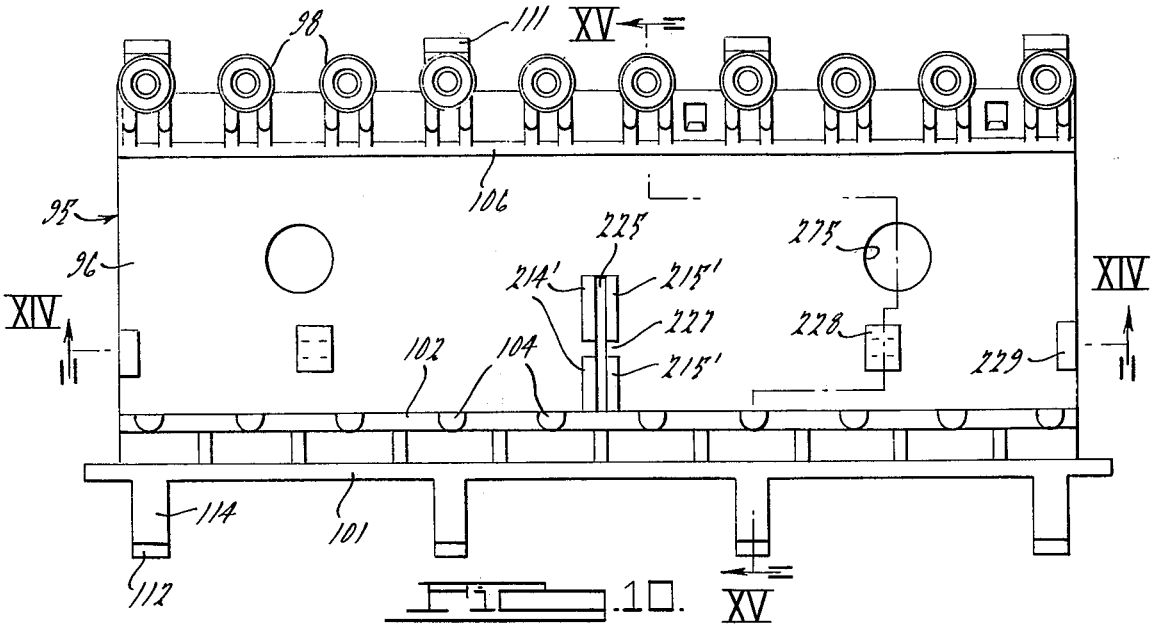
FIG. 10 is a plan view of the frame.
Figure 12:
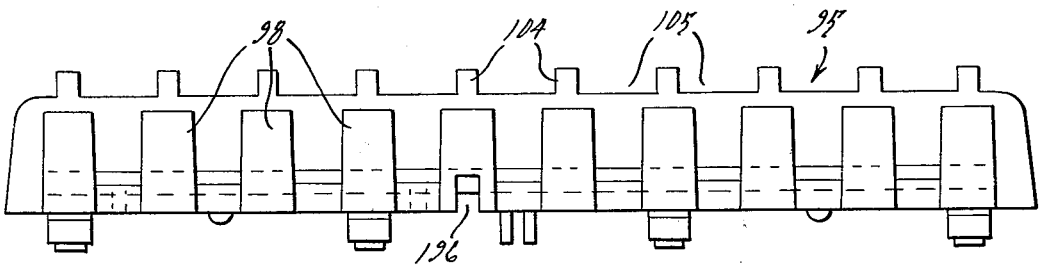
FIG. 12 is a rear elevational view of the frame.
Figure 14:
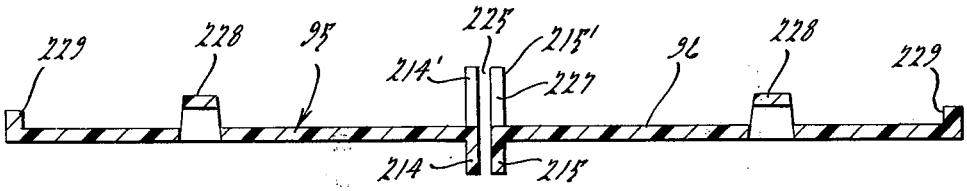
FIGS. 14 and 15 are cross-sectional views taken substantially on the lines XIV—XIV and XV—XV of FIG. 10 and looking in the direction of the arrows.
Figure 13:
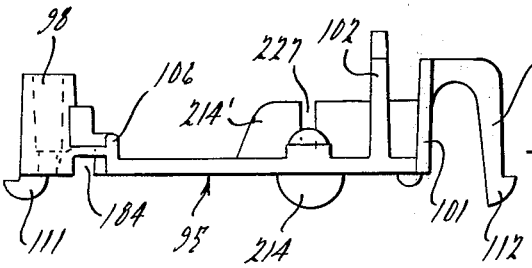
FIG. 13 is an end view taken as a projection to the right of FIG. 12.
Figure 15:
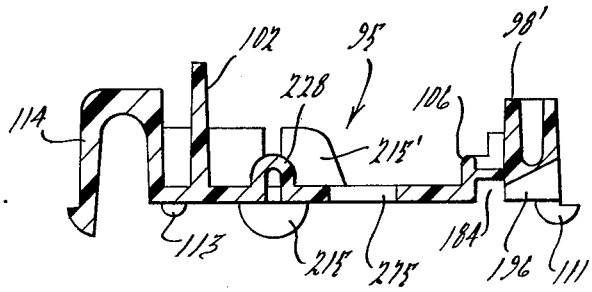
Figure 11:
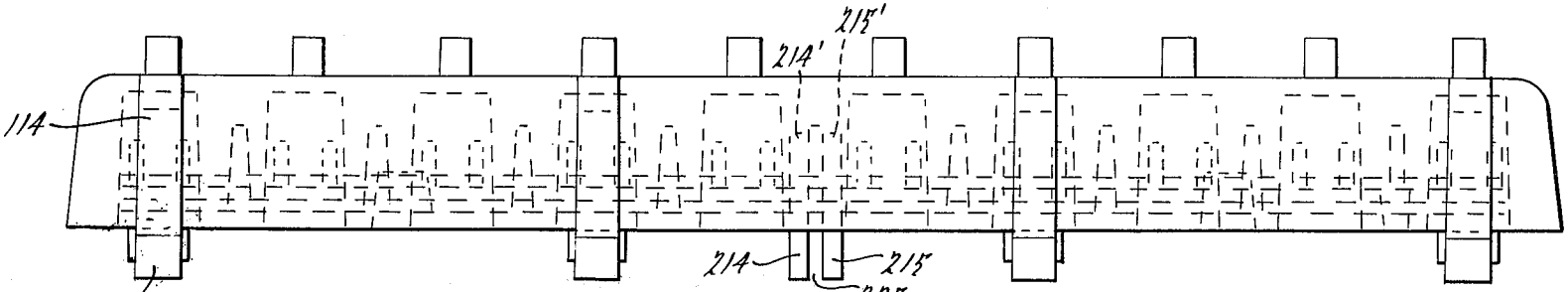
FIG. 11 is a front elevational view of the frame on a larger scale.

The housing of the improved cash register may be formed of sheet metal, and comprises a drawer compartment portion generally designated 50 formed as an inverted box and serving as a base for the machine. The drawer 51, shown closed in FIG. 3, is projectable in the usual fashion when released, as shown in FIGS. 7 and 9. The bottom of the drawer compartment or base 50 is closed by a sheet metal bottom plate 52 upon which the drawer rests.

A main casing portion 54, also formed of sheet metal, is upstanding from the base 50. Casing 54 is comprised of a front portion 56 and a rear portion 57, with the latter of which the side walls 58 are integral. The sheet metal components 50, 52 and 54 are secured together in a conventional manner as by suitable tongue and slot fastening means, indicated at 55, 55'. The sloping front wall 56' of the front portion 56 of the casing 54 constitutes a keyboard section and is provided with two transverse rows of openings (undesignated) for plunger-type pushbuttons 60, 61 which normally project therefrom.

The pushbuttons 60, 61 are formed integrally with corresponding indicator target portions 70 and 71 and with connecting and hinging portions by which these elements are supported and by means of which motion is transmitted from the pushbuttons to the indicator targets. These parts are formed as a single injection molded plastic component, generally designated 75, preferably of a plastic of the polyolefin family, e.g., polypropylene or Eastman's "Polyallomer", which are well-known plastics which in thin sections can be bent, and function practically indefinitely as a hinge without fracturing, whereas in thicker sections they are quite rigid and function effectively in structural components.

Figure 16:
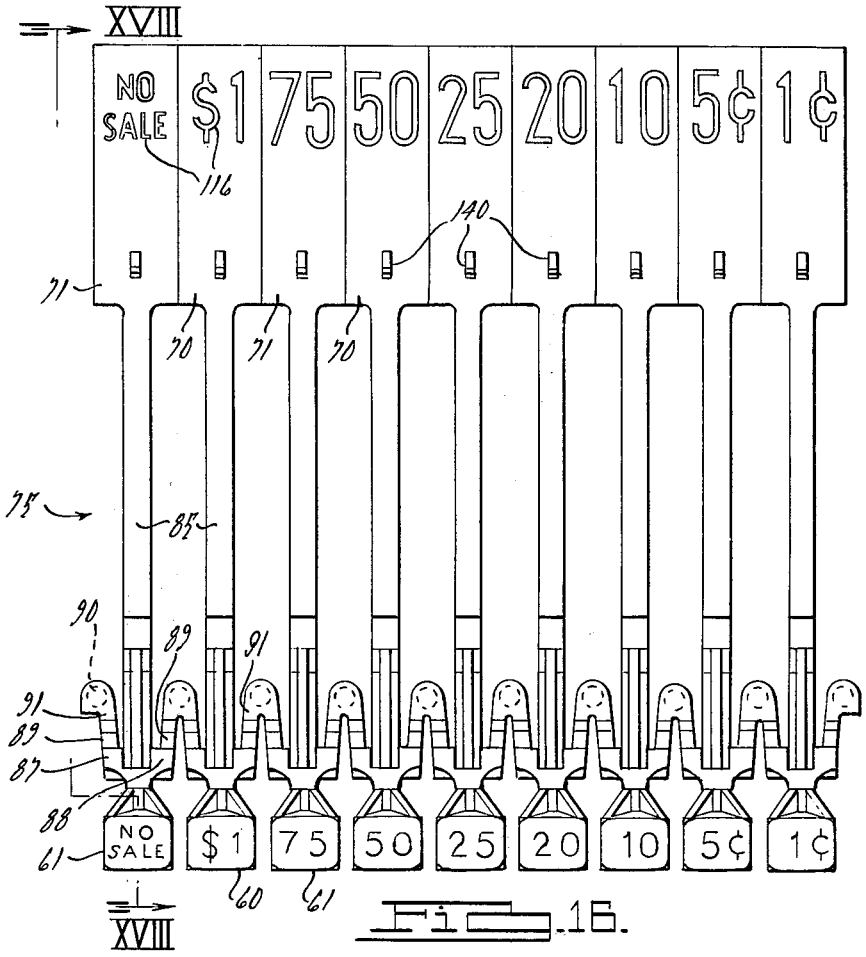
FIG. 16 is a front elevational view of the key-target assembly.
Figure 17:
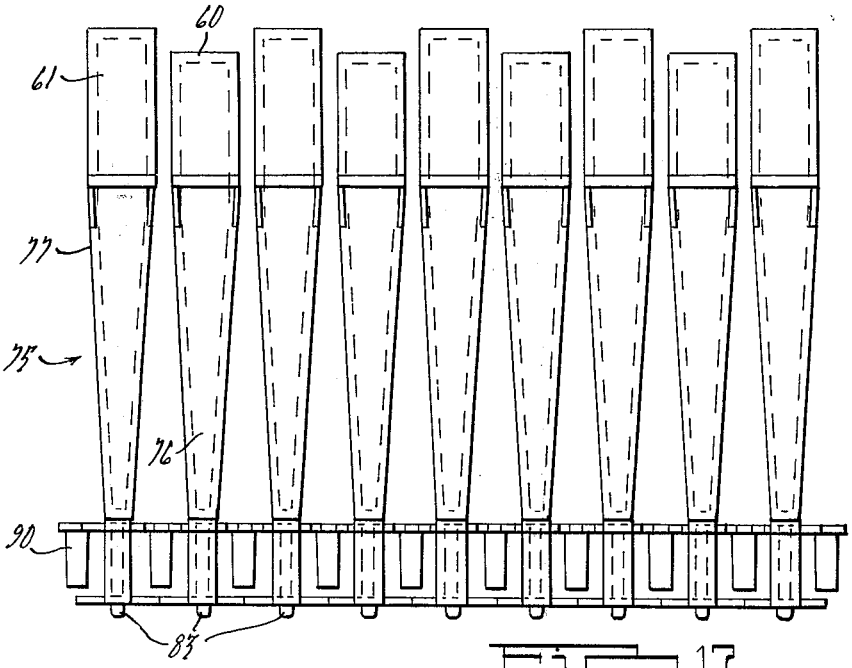
FIG. 17 is a bottom plan view thereof.
Figure 18:
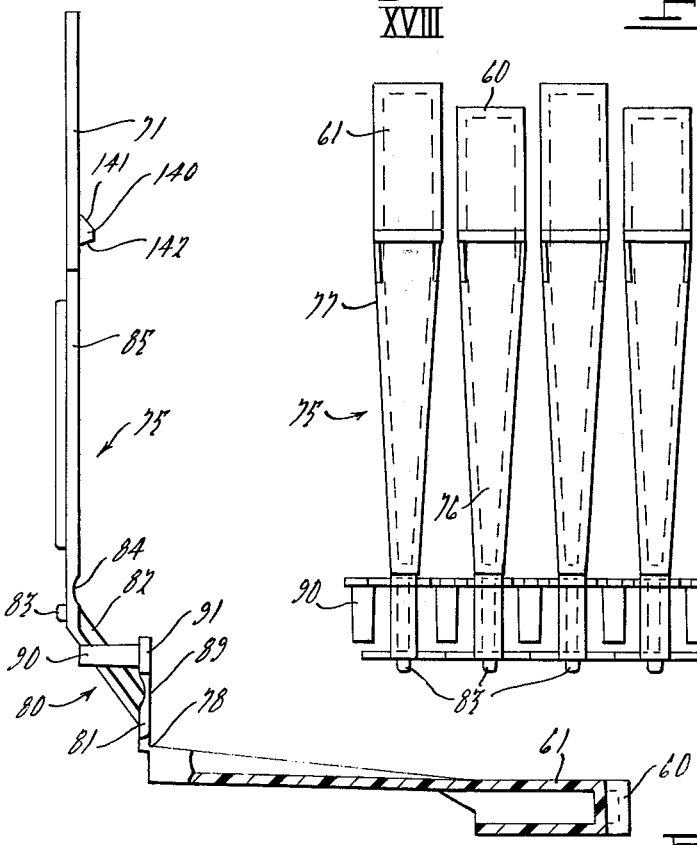
FIG. 18 is a sectional view taken substantially on the line XVIII—XVIII of FIG. 16 and looking in the direction of the arrows.
Figure 23:
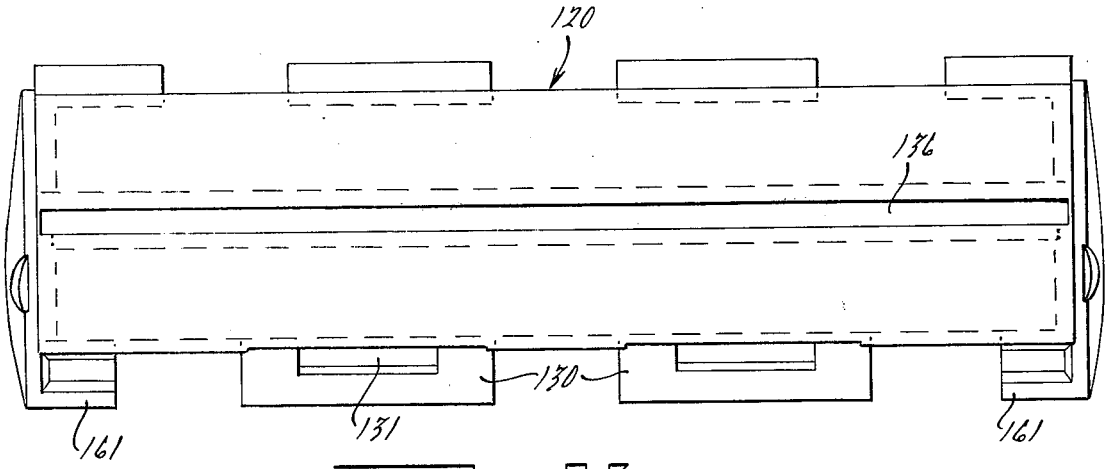
FIG. 23 is a plan view of the target guide.
Figure 24:
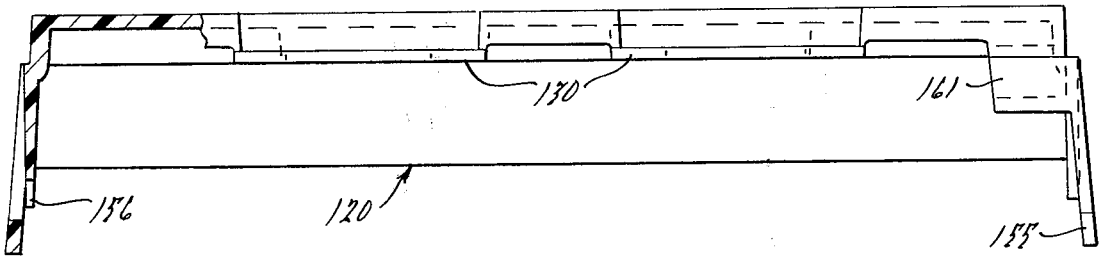
FIG. 24 is a front elevational view of the target guide, partly broken away.
Figure 25:
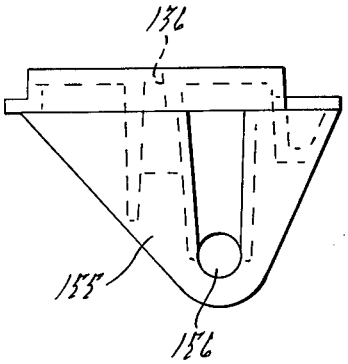
FIG. 25 is an end view, corresponding to a projection to the left of FIG. 24.
Figure 28:
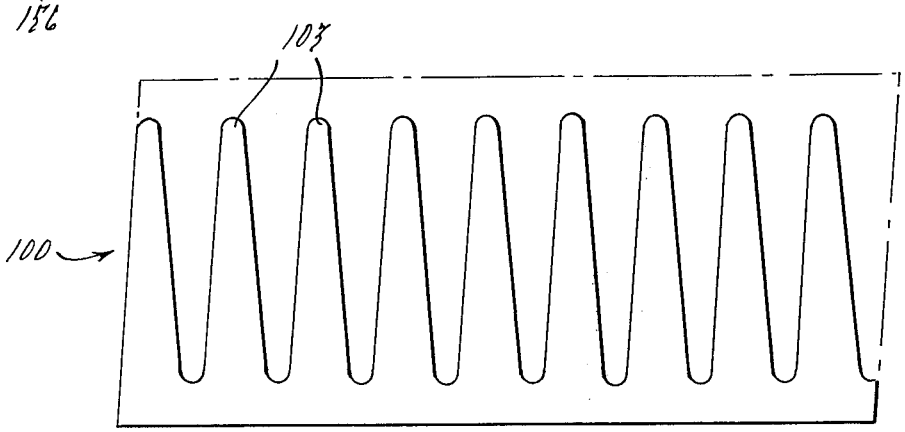
FIG. 28 is a plan view of the retractor spring.

The member 75 will be referred to as the key-target assembly (although it is actually a single unit, as noted). Its construction is best shown in FIGS. 16–18. As there shown, nine pushbuttons and targets are incorporated, although this is of course subject to variation. Each pushbutton portion 60, 61 has an integral supporting stem portion 76, 77 which is connected by a thinned hinge portion 78 to another thicker (and therefore stiffer) portion 80 which constitutes a lever of the first class. Each lever has a shorter arm 81 to which the hinge portion 78 is connected and a longer arm 82 connected by a second thinned hinge portion 84 to a stem portion 85 which carries the indicator target 70 or 71, as the case may be. All of the targets are molded as a single panel, and subsequently cut. Each of the lever sections, 80 also has a pair of rigid projections 87, 88 extending laterally from both sides thereof, continuations of the projections being extended rearwardly alongside the lever and comprising transversely aligned thinned hinging portions 89 defining the fulcrum of the lever. Rearwardly of the fulcrum hinge portions 89 the material is continued in a further thickened stiff section 91 defining a support arm which terminates in an integral downwardly projecting supporting pin portion 90. It will be seen that except at the two outer ends of the assembly, each of the pin portions 90 is connected to and serves to support two adjacent levers. The motion transmitting system consisting of the hinge portion 78, lever 80 and hinge portion 84 constitutes a flexible section located at the apex area of the converging stem portions 77-85 and 76-85 and reacts against the supporting structure comprising the base 50 via the fulcrum hinge portions 89, support 95, etc.

The key-target assembly and other supporting and operative components are preassembled before installation thereof in the housing structure. The method of assembly and installation will be described hereinafter; the parts will first be described with reference to their installed operative positioning.

A supporting frame generally designated 95 is secured to the top of the base 50 inside the casing 54. The construction of frame 95, which I have formed of molded polystyrene, is best shown in FIGS. 10 to 15, inclusive. A flat medial portion 96 of frame 95 lies on wall 53, extends transversely of the casing 54, and carries along its rear edge a series of upstanding tubular socket portions 98 open at the top to receive the supporting pin portions 90 of the key-target assembly, which pin portions are pressed into the sockets and may be held by friction. Along its front edge, frame 95 is provided with a pair of spaced parallel upstanding flanges 101, 102.

A multi-fingered comb-type retractor leaf spring generally designated 100 is supported by the flanges 101, 102. The retractor spring is preferably shaped so that two can be pressed without waste from a single rectangular blank, as is brought out by the broken line in FIG. 26. One of the fingers 103 is provided for each pushbutton-target pair, the fingers being spaced conformably to the spacing of the pushbutton stem portions 76, 77 and extending rearwardly beneath the extremities of such stem portions, as best shown in FIGS. 3–7. The spring 100 is flat in its relaxed condition but is held in an arched form by the flanges 101, 102, and by its confinement beneath the thickened lower extremities of the stems 76, 77. The fingers of the spring extend through locating notches 105 between the upwardly projecting parts 104 of a crenelated top formed on flange 102, the straight rear edge of the spring being wedged against the rear wall of flange 101. The ends of the fingers 103 extend rearwardly beyond the extremities of the stems 76, 77 and overlie a raised shoulder portion 106 formed on frame 95 forwardly of but close to the socket portions 98. The upward bias effect of the spring fingers 103 urges the longer forwardly-projecting arms 82 of the levers 80 upwardly, thereby biasing the stems 76, 77 and their pushbuttons upwardly and outwardly with respect to the keyboard section 56′ and also urging the targets downwardly. When a pushbutton is depressed fully, the stem slides inwardly through its hole in the keyboard section to the position shown in FIG. 5 at 61, and the lower corner portion as 107 of the corresponding stem, as 76, slides downwardly toward the apex area represented by the area toward which the key stems 76 and their corresponding target stems 85 converge. The corner portion 107 slides along the spring finger 103 while depressing it, and forces the tip of the finger downwardly against the shoulder 106. In the fully-depressed position of the button the corner 107 thereby distorts the spring finger to S-shape, increasing the elastic modulus of the spring so that when the target and button are subsequently released the target and pushbutton will be returned in a smart, quick fashion which overcomes any delay or slowness of action which might be caused by the memory factor of the plastic. A hammer portion which is a dimple 83 of solid plastic is formed at the end of each lever arm 82 and projects downwardly in position to strike the top wall 53 of base 50 when the target drops. Due to the substantial resonance factor of the sheet metal wall 53, this causes a noise which adds interest to the use of the machine.

The frame 95 is secured to the flat top wall 53 of the base 50 by means of integral hooks 111 and 112. The hooks 111 are formed as short rigid downward extensions of the body of the frame 95 along its rear edge and project through suitably positioned openings (undesignated) in the top wall 53 of the base. The hooks 112 are formed on the lower ends of spring arms 114 which extend forwardly and downwardly from the upper edge of front flange 101 and project through openings (undesignated) in top wall 53. The openings for the hooks 111 and 112 are so positioned that the hooks 112, which have inclined front walls, must be cammed toward the rear in order to enter the openings, whereafter the arms 112 snap forwardly and lock the frame 95 in position. Integral projections 113 on the bottom of the frame 95 extend into locating holes (undesignated) in top wall 53 of base 50 to prevent the frame from moving far enough to free the retaining hooks 111 after installation of the frame.

The stems 85 and their attached target portions 70 and 71 are straight and extend upwardly from the hinge portions 84 at their lower extremities through a target guide member 120 located in the top wall 115 of casing 54. When the targets are moved upwardly to the raised position they are visible through the window member 122, while when in the lowered position they lie substantially below the top walls 115, 118 of the casing 54 and target guide 122, respectively, so that the indica 116 thereon are obscured from view.

The target guide has been formed of a unitary polystyrene molding. A relatively large rectangular opening 121 in top wall 115 is defined by the rear edge of the front casing member 56, the forwardly inturned upper flange 57′ of casing part 57, and the edges of inturned flanges 58′ of end walls 58. Opening 121 is substantially filled by the flat top wall portion 118 of the target guide, although the target guide is enough smaller front to back to permit its insertion in opening 121 by shifting it to the front of the opening, to permit the interfitting of tongue parts (to be described) on the casing and target guide. The wall 118, which is substantially coplanar with the top wall 115 of casing 54, has vertical downturned front and rear marginal flanges 119 and vertical end hanger walls 155 which position it in the horizontal plane.

The inverted generally box-shaped transparent window member 122 has its open-bottomed walls proportioned to project between and substantially fill the space between the perimeter of the target guide 120, defined by flanges 119 and end walls 155, and the walls of the opening 121. The rear portion of top wall 115 of the casing section 54, defined by the flange 57′, has tongue portions 126 coplanar therewith and which project forwardly from the rear edge of the opening 121 and which underlie the top wall 118 of the target guide 120 along the rear edge thereof. The front portion of top wall 115, defined by the rear edge of front wall 56, also has tongues 127 projecting rearwardly horizontally, but stepped downwardly from, the front edge of the opening 121. Tongues 126, 127 also underlie the bottom edges of the front and rear walls of the window member 122, which is formed of a tough transparent plastic such as a molded polystyrene copolymer. In the areas between the tongues 126, the rear edge of the target guide 120 has depressed rearwardly extending horizontal tongue portions 128 underlying the wall 115 rearwardly of the opening 121 and preventing upward displacement of the target guide. Hooked flange portions 129 on the lower edge of rear wall 125 of the window member 122 also project rearwardly and underlie the top wall 115 behind the rear edge of opening 121. Hook portions 129 extend between the tongue portions 128 and the lower surface of top wall 115. In the areas between the front tongues 127 on the casing, the target guide 120 is provided with two integral downwardly-displaced forwardly-extending horizontal tongues or flanges 130 each of which has a longitudinal slot 131 therein. The flanges 130 extend forwardly beneath the downturned front edge wall 116 of the opening 121, thereby preventing upward displacement of the target guide 120. The front wall 124 of the window member has portions 123 which project downwardly through the slots 131 and carry at their lower extremities forwardly hooked retaining portions 135 which underlie the flanges 130 forwardly of the slots 131, thereby retaining the window member 122. The window member locates the target guide 120 against unwanted horizontal shifting and maintains the respective tongue portions in their interlocked retaining relationship.

Figure 4:
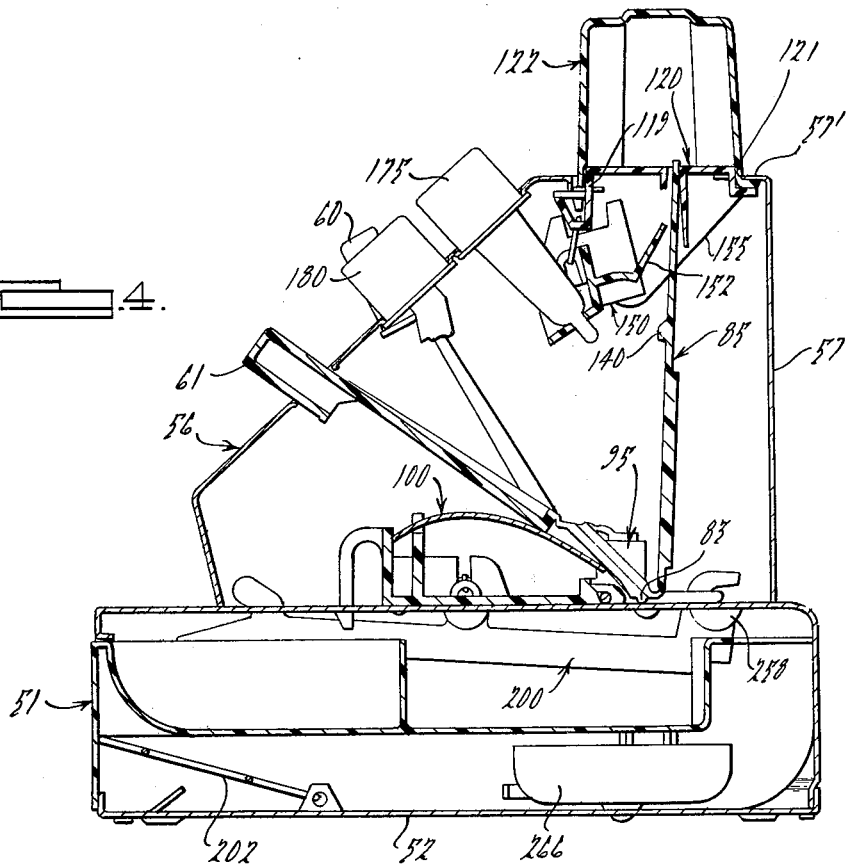
FIGS. 4, 5 and 6 are similar vertical sectional views on a somewhat smaller scale taken substantially on the line IV—IV of FIG. 2, and looking in the direction of the arrows, and showing the parts in different operative positions.
Figure 5:
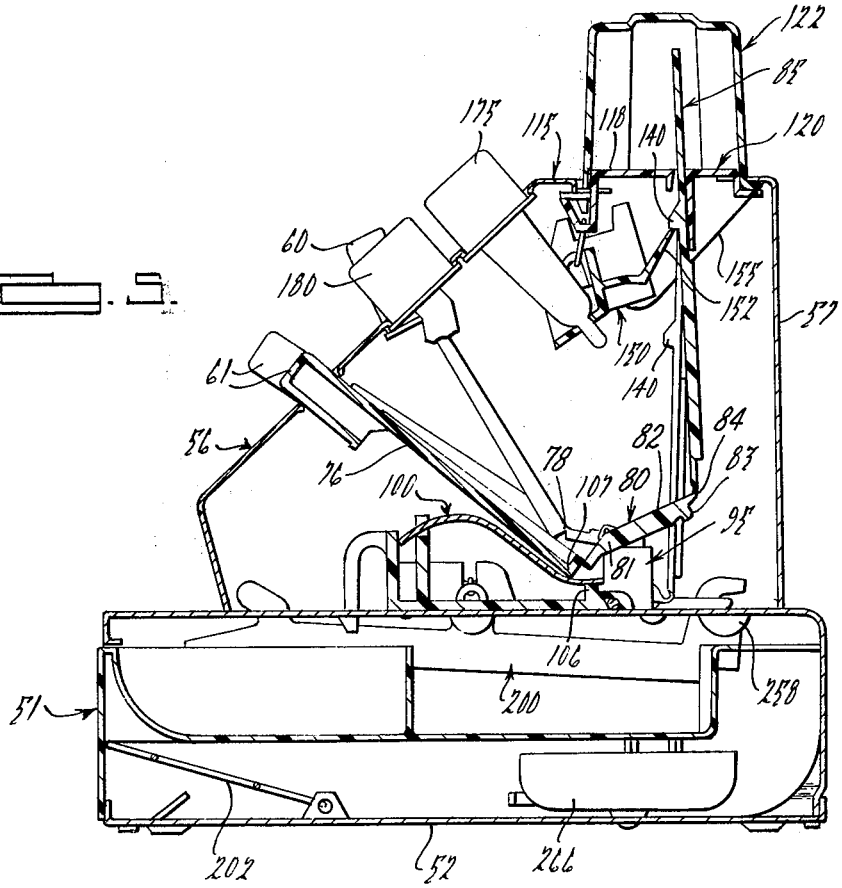
Figure 6:
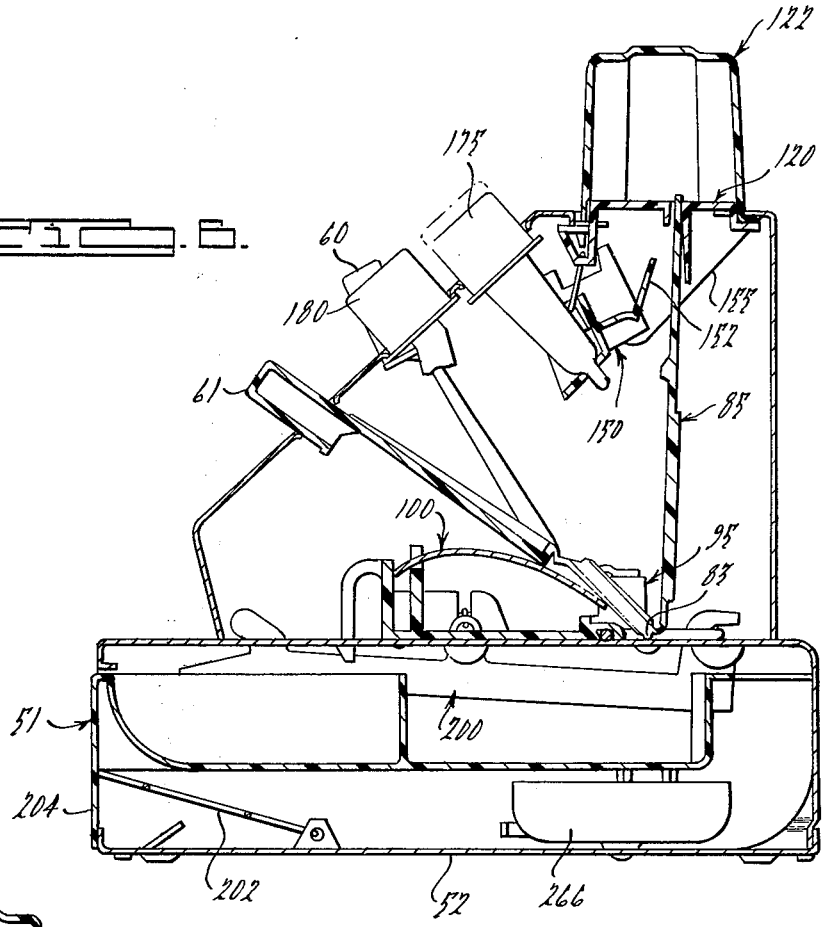

The top wall 118 of target guide 120 has a longitudinal vertical slot 136 through which the target portions 70, 71 are vertically slidable between upwardly projected raised positions, as shown in FIG. 5, in which the indicia 116 thereon are visible through the window, and lowered positions, as shown in FIGS. 4, 6 and 7 wherein the indica lie below the opaque top walls 118, 115 and are hidden from view.

Integrally projecting from the front surface of each target is an abutment generally designated 140 having a sloping top surface 141 inclined outwardly and downwardly at an acute angle to the face of the target, and a lower surface 142 inclined rearwardly and downwardly at an obtuse angle to the face of the target.

Figure 20:
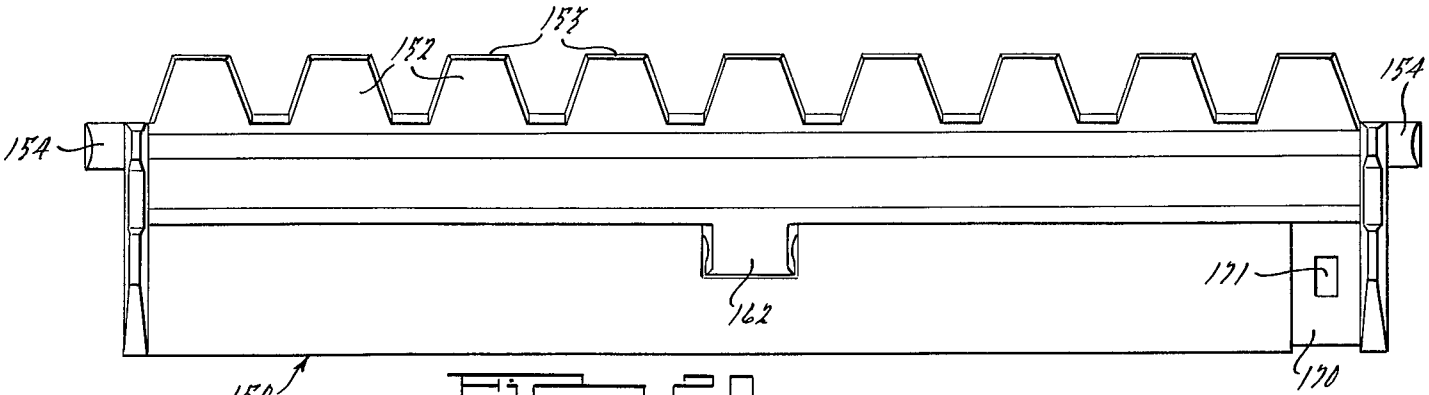
FIG. 20 is a plan view of the target latch.
Figure 21:
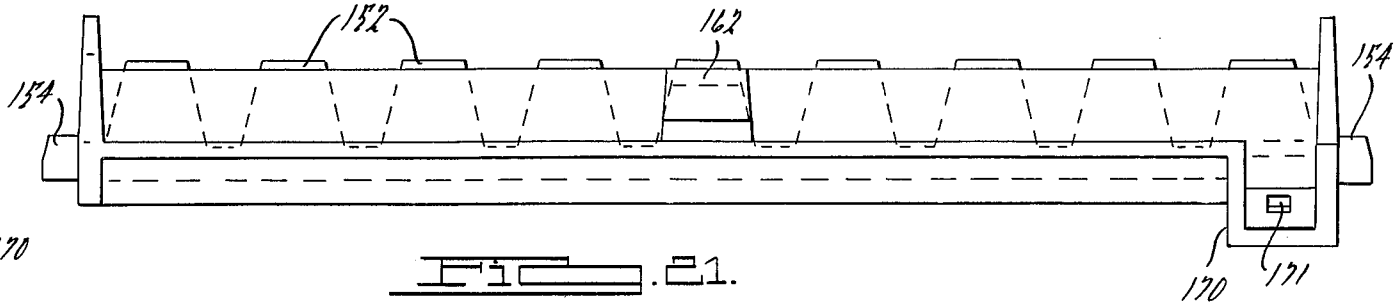
FIG. 21 is a front elevational view thereof.
Figure 22:
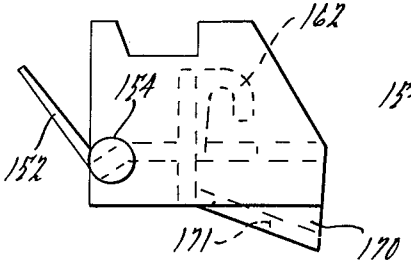
FIG. 22 is an end view corresponding to a view taken from the left end of FIG. 21.

A latch member is provided, the details of constuction of which are best shown in FIGS. 20–22, consisting of a rockable frame generally designated 150 extending transversely and parallel to the plane of the targets and having integral fingers 152 rockable therewith in such manner that the upper horizontal end portions 153 of the fingers are movable to and from a position lying in the path of the respective abutment portions 140. The frame 150 has integral coaxial stubshaft portions 154 at its ends by means of which it is trunnioned in the end hanger walls 155 which are suitably apertured therefor as indicated at 156.

The latch member frame 150 is biased, in a clockwise direction as viewed in FIGS. 4 to 6 inclusive, to yieldably urge it to the holding position wherein the fingers 152 are in the intefering position. In such position, the lower wall 142 of the abutment 140 of any target which is raised, will overlie the top edge 153 of the corresponding finger 152 of the latch member, the target thereby being held in the raised position. The latch member is biased to such position by a wire spring 160 which is straight in the relaxed position, and which is hooked at its ends in pocket-defining portions 161 formed integrally with and projecting forwardly from the ends of the target guide member 120. The central portion of the spring wire 160 extends through a hook 162 on the latch member 150 located forwardly of the fulcrum axis defined by the stubshaft portions 154, so that the spring biases the fingers rearwardly.

The latch member is formed as an integral injection molded polystyrene unit. The fingers 152 are thin enough so that they are relatively flexible, and the strength of the bias spring 160 and the proportioning of the abutments 140 are such that the outward camming effect of the abutment 140 of a target which is being raised does not rock the latch member (counterclockwise, as viewed in FIGS. 4–6) far enough to cause any other fingers which may be underlying a raised target to move outwardly far enough to free the abutment and allow such other raised target or targets to drop. Thus any number of the targets may be raised in sequence without thereby releasing any of the other targets.

In order to permit the operator to release the targets when desired, the latch frame 150 is provided with a lever arm 170 inclined forwardly and downwardly therefrom at one end and having a slot 171 therein. A pushbutton 175 which projects through and above a suitably-positioned opening (undesignated) in the keyboard section 56 has a plunger portion 177 with a reduced lower extremity 178 which extends into the slot 171. The pushbutton 175 and plunger 177 are normally held in the raised position by the biasing spring 160, but depressing the button rocks the latch member in a direction to move the fingers away from the targets far enough to free the abutment and permit raised targets to drop.

Another pushbutton 180, similarly mounted in an (undesignated) suitably-positioned opening in the keyboard section 56, has attached thereto a plunger 181, the lower extremity of which projects through and is guided by a slot (undesignated) in the top wall 53 of the base 50. A crank, generally designated 182, is rockably supported in a downwardly-opening slot 184 in the bottom of the frame 95 and has one arm 183 pivoted in the lower portion of the plunger 181 and a second arm 185 which projects rearwardly from the frame member 95 through a slot 196 in one of the socket portions, designated 98′ in FIG. 15, and is hooked in a slot 198 in a drawer latch arm generally designated 200.

Figure 8:
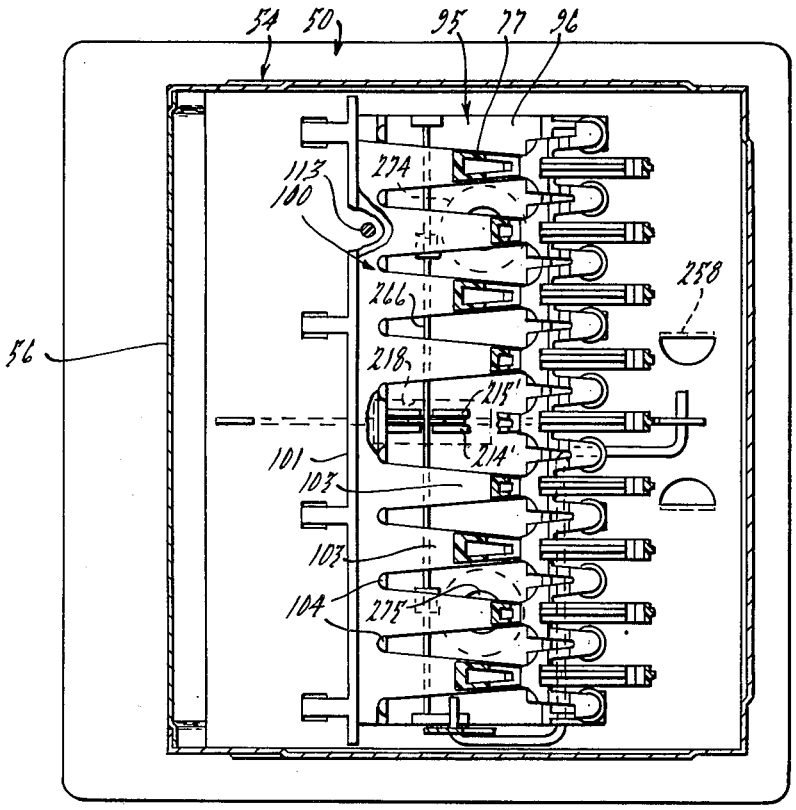
FIGS. 8 and 9 are horizontal sectional plan views taken substantially on the lines VIII—VIII and IX—IX, respectively of FIG. 3.

The drawer 51 is biased outwardly by a wire spring 202 which is looped to substantially circular shape but which when the drawer is closed is distorted to oval shape, as shown in FIG. 9, by the depending front wall 204 of the drawer. The spring 202 lies beneath the drawer and has its two spaced rear ends hooked into and retained by tongues 205 struck up from bottom plate 52. The tongues 205 have front edges which incline rearwardly at approximately 60° toward the top, and the hooked ends 203 of spring 202 are of generally S-shape, as shown in FIG. 8. The expansive force of the spring causes the parts thereof near the S-bend, which parts are forced against the inclined front edges of the tongues 205, to exert a cam-like force urging the spring to and holding it in an upwardly position, as nearly perpendicular to the inclined edges as possible. The spring is thereby kept in effective engagement with the drawer and prevented from projecting out underneath the drawer front.

The drawer latch arm 200 comprises a flat sheet metal member lying on a central vertical plane and extending toward the front and rear of the assembly beneath the top wall 53 of the base. Near its forward end the latch arm has an upwardly and forwardly inclined tongue 208 hooked in a slot (undesignated) in wall 53. The juncture of tongue 208 with the straight bottom portion of the latch arm 200 defines a pivot for vertical swinging movement of the arm. The rear end of the latch arm has an upwardly extending tongue 210 which extends through and is guided in a slot in the wall 53 and is notched at 198 to receive the crank arm 185. A mid portion of the latch member 200 has an integral tongue 212 which extends upwardly through a slot-like opening 225 between two laterally spaced downwardly projecting flanges 214, 215 integral with frame 95, and through upwardly extending coplanar continuation flanges 214', 215', also integral with frame 95. The downwardly extending flanges 214, 215 project through an opening 218 in wall 53, and coact with the flanges 214', 215' to define slide bearings for the sheet metal latch arm 200, which is thereby effectively held against substantial lateral movement and accurately guided in its vertical movement. In FIG. 8 the central one of the spring fingers 103 is broken away to show the positioning of flanges 214', 215' and the aperture 218. A shoulder 220 on the rear of the latch arm 200 is movable vertically to and from an interfering position with the rear wall 222 of the drawer 51 by rocking movement of the latch member in a vertical plane around the pivot axis defined by the front tongue 208.

The flanges 214', 215' extend upwardly to a position higher than that occupied by the top edge of the tongue 212. A transverse slot 227 extends downwardly through flanges 214', 215', intersecting slot 225. A wire spring member 226, which is straight when relaxed, is arched over the top edge of the tongue 212 within the slot 227, and is confined by looped retainers 228 and abutment flanges 229 formed on the frame 95. Spring 226 biases the rear end of the latch down to the drawer-holding position, and the pushbutton 180 to the raised position. As the drawer is moved to the closed position, the latch arm, which has a straight lower edge, is cammed upwardly by the rear wall 222 of the drawer, and when the drawer reaches the fully-closed position the rear of the arm moves downwardly so that the shoulder 220 then retains the drawer in the closed position. Outward movement of the drawer is limited by an abutment tongue 251 depending integrally from the bottom of the drawer. The drawer is also formed as a unitary molded plastic member. A tongue 252 struck up from the bottom plate 52 blocks the abutment 251 to limit the projection of the drawer. The drawer is provided with a transverse central partition 253. The partition 253 and rear wall 222 are provided with aligned vertical slots 256, 257, respectively, which are narrow and of a width to just slidably receive the latch arm 200. The latch arm thus serves as a guide to center the drawer in the front drawer opening. Rounded hold-down tongues 258 struck downwardly from wall 53 and positioned to overlie and prevent upward movement of the back wall 222 of the drawer insure proper disengagement of the latch bar when button 180 is depressed.

When the drawer is fully closed, the abutment 251 which has an inclined rear edge 254 lies to the rear of a spring clapper arm 265, also of molded plastic, for a bell 266. The clapper arm and bell are riveted to the top of bottom 52 under the raised bottom of the drawer. In moving forwardly, the abutment 251 moves the clapper arm 265 forwardly until the abutment slides past the free end of the clapper arm, which then moves rearwardly, under the spring effect of its own resiliency, and a metal button 268 thereon strikes the bell.

It will be noted that the ears 205 which secure the ends of the looped drawer spring 202 are spaced on either side of the centerline, so that the abutment 251 can move between them, to and from engagement with the abutment 252. The spring 202 reaches the limit of its expansion before the drawer reaches the fully open position, but the inertia of the drawer carries it to the fully open position. The position and length of the clapper arm 265 are such that the abutment 251 moves free of the clapper arm while the spring is exerting power on the drawer, or close to the limit of expansive movement of the spring.

Assembly of the cash register is carried out in the following manner: The target guide 120 and target latch 150 with target latch spring 160 are preassembled with the window 122 in the upper casing 54. The key-target assembly 75 and retractor spring 100, together with the drawer latch bar spring 226, and crank 182 are also preassembled with frame 95. The metal upper casing 54 with the target guide and target latch therein are supported in an inverted position. The key-latch assembly 75 is then installed in the inverted upper casing, targets 70, 71 being passed through slot 136 in the target guide 120 and the pushbuttons 60, 61 being passed through their respective openings in the keyboard section 56. Drawer release button 180 and target latch release button 175 are inserted, and are held from falling through their respective openings in the keyboard section 56 by flanges at the lower ends of the pushbutton parts. Plunger 181, which was previously inserted and held in a slot (undesignated) in the pushbutton 180, has a hole (undesignated) which is hooked over the inturned end of arm 183. The base 50 is then positioned. The hooks 111 are passed through their slots, and a hooked tool (not shown, but comprising a simple double hook, as will be obvious) is then projected through a pair of openings 274 in the wall 53, and through the aligned openings 275 in the wall 96 of frame 95, and used to pull the frame against the (inverted) top surface of wall 53. The hook portions 112 at such time snap through their receiving slots and move forwardly to lock the operative parts to the wall 53. The tongues 55 are then bent to lock the upper casing portion 54 to the base 50 and retain the operative parts. The looped spring 202, bell 266 and clapper 265 are preassembled to bottom wall 52 of the drawer compartment, and the bottom wall is then secured by means of tongues 55'. The drawer 51 is installed by pushing it into place. The tongue 252 and the bottom wall 52 yield sufficiently to permit the abutment 251 to pass thereover, but return to position and will not thereafter permit the escape of the drawer.

This Detailed Description of Preferred Form of the Invention, and the accompanying drawings, have been furnished in compliance with the statutory requirement to set forth the best mode contemplated by the inventor of carrying out the invention. The prior portions consisting of the "Abstract of the Disclosure" and the "Background of the Invention" are furnished without prejudice to comply with administrative requirements of the Patent Office.

What is claimed is:

1. A toy cash register having a supporting structure and including a keyboard section, said section having openings therein for the slidable reception of pushbuttons, characterized by the combination which comprises paired pushbutton and indicator target portions formed as relatively stiff integral parts of a single piece of plastic, said parts being joined to each other by a relatively flexible integral medial section, said parts being slidable, in paths lying at an angle to each other, toward and from an apex area in the vicinity of said flexible medial section, the medial section being located by and reacting against the supporting structure to transmit motion between said pushbutton and indicator target portions.

2. A toy cash register as defined in Claim 1 wherein said flexible medial section comprises two longitudinally spaced hinging portions and an intermediate part between said hinging portions, and also integral therewith, and rockably connected to the supporting structure.

3. A toy cash register a defined in Claim 2 wherein the intermediate part comprises a relatively stiff lever section, and additional fulcrum hinging means for rockably connecting said lever section to said supporting structure.

4. A toy cash register as defined in Claim 2 wherein the intermediate part includes a relatively stiff lever section, and additional integral fulcrum hinging means for rockably connecting said lever section to said supporting structure.

5. In a toy cash register as defined in claim 3, spring means reacting against the lever section and against the supporting structure.

6. A toy cash register as defined in claim 1, including a plurality of such pushbutton portions and a plurality of such indicator target portions, all of the medial sections thereof being integral with each other.

7. A toy cash register as defined in claim 3, including a plurality of such pushbutton portions and a plurality of such indicator target portions, and securing means attaching said fulcrum hinging means to said supporting structure, all of said hining means and securing means and lever sections being integral with each other and with said pushbutton and indicator target portions.

8. A toy cash register as defined in claim 3, including a plurality of such pushbutton portions and a plurality of such indicator target portions, and securing means attaching said fulcrum hinging means to saiid supporting structure, and a comb-type spring carried by the supporting structure and having a plurality of fingers, each finger reacting against one of said lever sections.

9. A toy cash register as defined in claim 8 wherein each of said fingers has an attached end and a free end, the portions of said fingers which react against the lever sections being intermediate the ends thereof, and abutment portions carried by the supporting structure engageable by the free ends of the fingers when the fingers are stressed, to increase the elastic modulus thereof.

10. A toy cash register as defined in claim 7, including a comb-type spring carried by the supporting structure and having a plurality of fingers, each finger reacting against one of said lever section.

11. A toy cash register as defined in claim 10 wherein each of said fingers has an attached end and a free end, the portions of said fingers which react against the lever sections being intermediate the ends thereof, and abutment portions carried by the supporting structure engageable by the free ends of the fingers when the fingers are stressed, to increase the elastic modulus thereof.

12. A toy cash register as defined in claim 1 wherein said piece of plastic is a molded polypropylene.

13. A toy cash register as defined in claim 1 wherein said piece of plastic is a molded plastic of the polyolefin family.

14. A toy cash register as defined in claim 7 wherein said piece of plastic is a molded polypropylene.

15. A toy cash register as defined in claim 7 wherein said piece of plastic is a molded plastic of the polyolefin family.

16. A toy cash register as defined in claim 1, including a plurality of pairs such pushbutton portions and indicator target portions, and a comb-type spring carried by the supporting structure and having a plurality of fingers, each finger reacting against one of said pairs.

17. A toy cash register as defined in Claim 16 wherein each of said fingers has an attached end and a free end, the portions of said fingers which react against the lever sections being intermediate the ends thereof, and abutment portions carried by the supporting structure engageable by the free ends of the fingers when the fingers are stressed, to increase the elastic modulus thereof.

18. A toy cash register as defined in Claim 7 wherein the target portions are arranged in a row and the supporting structure also includes a plastic frame member having supporting portions for said securing means extending parallel to the row of targets, and having integral supporting means for said comb spring farther from the targets than said securing means and also extending parallel to the targets and to the supporting portions for said securing means.

19. A toy cash register as defined in claim 3 wherein the lever section is a lever of the first class.

20. A toy cash register as defined in Claim 3 wherein the lever section is a lever of the first class, both of said portions constituting the paired pushbutton and indicator target portions including integral thrust-transmitting extension portions hinged to the lever by thinned sections of said piece of plastic.

21. A toy cash register as defined in Claim 3 wherein the lever section is a lever of the first class, both of said portions constituting the paired pushbutton and indicator target portions including integral thrust-transmitting extension portions hinged to the lever by thinned sections of said piece of plastic, said last-mentioned thinned sections defining the fulcrums of the lever sections.

22. A toy cash register as defined in claim 7 wherein the lever sections have integral fulcrum carrying arms extending from both sides thereof, all of said arms being integral with each other.

23. A toy register as defined in Claim 18 wherein the lever sections levers of the first class, the pushbutton portions and the target portions each having a thrust-transmitting extension, each extension being hinged to one end of one of the levers by a thinned section of the piece of plastic.

24. A toy cash register as defined in Claim 22 wherein the levers are of the first class, the pushbutton portions and the target portions each having a thrust-transmitting extension, each extension being hinges to one end of one of the levers by a thinned section of the piece of plastic.

25. A toy cash register as defined in Claim 1 wherein said supporting structure includes metal having a resonance factor, further characterized by a with such portion movable with the indicator target portion and engageable withsuch metal portions to produce an audible indication of movement of the target portions.

26. A toy cash register as defined in Claim 7 wherein each of said lever sections has a shorter arm connected to one of said pushbuttons and a longer arm connected to one of said target portions.

27. A toy cash register as defined in Claim 26 including portions on said supporting structure having a substantial resonance factor, further characterized by a hammer portion located near and fast with respect to the outer end of each longer arm and engageable with said portions of the supporting structure to resonate the same in response to movement of the targets.

28. A cash register as defined in claim 7 wherein the fulcrum axes of all of the fulcrum hinging means are colinear and each pair of adjacent lever sections is united by an integral connection to a common integral interposed securing portion which constitutes a part of said securing means.

29. A toy cash register having a supporting structure and including a keyboard section, said section having openings therein for the slidable reception of pushbuttons, characterized by the combination which comprises paired pushbutton and indicator target portions formed as relatively stiff plunger-like parts, a plurality of levers of the first class fulcrumed on said supporting structure, one lever being provided for each paired pushbutton and target portion, said pushbutton and target portions being articulated to opposite arms of said levers and said pushbutton and target portions being slidable, in paths lying at an angle to each other, toward and from an apex in the vicinity of said levers.

30. A toy cash register as defined in claim 29 wherein each pushbutton portion and the lever connected thereto are formed of plastic sections integral with a hinging part which articulates the same.

31. A toy cash register as defined in claim 29 wherein each target portion and the lever connected thereto are formed of plastic sections integral with a hinging part which articulates the same.

32. A toy cash register as defined in claim 29 wherein each lever and the paired pushbutton and target portions connected thereto are formed of plastic sections integral with hinging parts which articulate the same.

* * * * *

UNITED STATES PATENT AND TRADEMARK OFFICE

CERTIFICATE OF CORRECTION

PATENT NO. : 3,957,198

DATED : May 18, 1976

INVENTOR(S) : James E. Thomson

It is certified that error appears in the above-identified patent and that said Letters Patent are hereby corrected as shown below:

Column 4, line 30, after "moving", insert --forwardly--.
Column 4, line 40, "indica" should be --indicia--.
Column 6, line 64, after "upwardly", insert --inclined--.
Column 8, line 1, after "bottom", insert --plate--.
Column 9, line 48 (Claim 8, line 4), "saiid" should be --said--.
Column 10, line 15 (Claim 16, line 2), after "pairs", insert --of--.
Column 10, line 57 (Claim 23, line 1), after "toy", insert --cash--.
Column 10, line 58 (Claim 23, line 2), after "sections", insert --comprise--.
Column 10, line 66 (Claim 24, line 4), "hinges" should be --hinged--.
Column 11, line 2 (Claim 25, line 2), after "metal" insert --portions--.
Column 11, line 2 (Claim 25, line 3), delete "with such" and insert --hammer--.
Column 12, line 11 (Claim 29, line 13), after "apex" insert --area--.

Signed and Sealed this

Third Day of August 1976

[SEAL]

*Attest:*

RUTH C. MASON
*Attesting Officer*

C. MARSHALL DANN
*Commissioner of Patents and Trademarks*